US007199758B2

(12) United States Patent
Ikeda et al.

(10) Patent No.: US 7,199,758 B2
(45) Date of Patent: Apr. 3, 2007

(54) ANTENNA DEVICE

(75) Inventors: Tomoki Ikeda, Ota-ku (JP); Norio Tanaka, Ota-ku (JP); Naofumi Shiraishi, Ota-ku (JP); Hideaki Oshima, Minato-ku (JP); Seiji Katakura, Minato-ku (JP); Hiroshi Iijima, Minato-ku (JP)

(73) Assignees: ALPS Electric Co., Ltd., Tokyo (JP); Nippon Sheet Glass Company, Limited, Tokyo (JP)

( * ) Notice: Subject to any disclaimer, the term of this patent is extended or adjusted under 35 U.S.C. 154(b) by 0 days.

(21) Appl. No.: 11/157,616

(22) Filed: Jun. 21, 2005

(65) Prior Publication Data

US 2005/0285805 A1 Dec. 29, 2005

(30) Foreign Application Priority Data

Jun. 25, 2004 (JP) ..... 2004-188093

(51) Int. Cl.
*H01Q 1/38* (2006.01)
*H01Q 9/38* (2006.01)
*H01Q 1/48* (2006.01)

(52) U.S. Cl. ..... 343/700 MS; 343/830; 343/846

(58) Field of Classification Search ..... 343/711, 343/713, 700 MS, 830, 846
See application file for complete search history.

(56) References Cited

U.S. PATENT DOCUMENTS 5,568,157 A * 10/1996 Anderson ..... 343/713
6,140,968 A * 10/2000 Kawahata et al. ... 343/700 MS
2006/0109178 A1* 5/2006 Takeuchi et al. ..... 343/700 MS

FOREIGN PATENT DOCUMENTS

| | | |
|---|---|---|
| GB | 628283 | 8/1949 |
| JP | 09018226 | 1/1997 |
| JP | 2000013123 | 1/2000 |
| WO | WO 03-105278 A1 | 12/2003 |
| WO | WO-03/105278 A1 | 12/2003 |
| WO | WO 2004-004070 A1 | 1/2004 |

OTHER PUBLICATIONS

K. Rothammel, Antennenbuch, 2001, pp. 102-105, Darc Verlag Bauntal, DE.

* cited by examiner

*Primary Examiner*—Shih-Chao Chen
(74) *Attorney, Agent, or Firm*—RatnerPrestia

(57) ABSTRACT

An antenna device is provided in which a common mode current does not flow in a coaxial cable. The coaxial cable is uprighted at the end of the base plate and bent toward the notched portion of the cover so that the connector reaches to the notched portion. A short-circuit stub structure is provided in such a manner that a part of the outer sheath of the coaxial cable is removed to expose the outer conductor and a ring-shaped metal terminal is crimped to the exposed outer conductor. The ring-shaped metal terminal is fixed by using a screw to an acceptance member made of a stainless steel provided on the base plate. The terminal is provided at the position within 0.25λ from the feeding point of the ground antenna element.

7 Claims, 8 Drawing Sheets

PRIOR ART

NO STUB STRUCTURE

STUB STRUCTURE

ANTENNA DEVICE

BACKGROUND OF THE INVENTION

1. Field of the Invention

The present invention relates to an antenna device, particularly to an antenna device formed on a window glass panel of a motor vehicle.

2. Related Art

In the case of an antenna having a frequency band of GHz or more for a motor vehicle, it is generally desired that the entire structure of the antenna is formed on the surface of a window glass panel considering the size of the antenna. In this case, it is difficult to provide a through hole in a glass panel at a feeding point of the antenna, so that the antenna must be formed on one surface of a window glass panel. An antenna formed on one surface of a window glass panel is referred to as a coplanar antenna. As a coplanar antenna, the antenna disclosed in Japanese Patent Publication No. 08-148921 and PCT International Publication No. WO3/105278 is known.

In order to give a directivity to the antenna disclosed above-described Publications, it is conceivable that a reflector disclosed in PCT International Publication No. WO2004/004070 is provided. In this case, it is preferable that a box-shaped electronic circuit unit comprising integrally an electronic circuit including an amplifier for amplifying a received signal to increase the performance of an antenna, a reflector, and a housing, and having an opening is provided detachably in such a way that the unit covers a planar antenna formed on a window glass panel through a base plate without DC coupling between the antenna and the electronic circuit unit.

The reason why the electronic circuit unit is provided detachably is to make an exchange thereof easy if the unit is failed. In this case, a coaxial cable is used for connecting between the feeding points of the antenna and the amplifier. However, it is undesirable that the coaxial cable is unnecessarily extended of the stage previous to the amplifier, because there is no merit to provide the amplifier and the S/N ratio is degraded, if a signal attenuation is large. Accordingly, the amplifier is provided in the electronic circuit unit near to the antenna as described above.

Even if the length of the coaxial cable is short, the following problem is caused. That is, a coaxial cable is an unbalanced circuit, so that a common mode current through a central conductor and outer conductor of the coaxial cable is caused in addition to a normal mode current through the central conductor and outer conductor of the coaxial cable. This is due to the fact that a ground antenna element to which the outer conductor of the coaxial cable is connected and a metal plate (a ground plane) which constitutes the outer wall of the electronic circuit unit are capacitively connected to form a pseudo signal path between the outer conductor of the coaxial cable and the ground plane, thereby the common mode current which is originally unnecessary is induced.

In FIG. 1, there is shown the condition in which a common mode current flows through a coaxial cable 12 connected to a balanced antenna. When such a common mode current flows, the common mode current is added to the original normal mode current, so that the exciting current distribution of the antenna and coaxial cable is put out of order, resulting in a remarkable degradation of the reception performance of the antenna. The common mode current is varied depending on the wiring state and the length of the coaxial cable, so that the reception performance of the antenna is also varied. Accordingly, the common mode current through the coaxial cable is extremely undesirable current.

SUMMARY OF THE INVENTION

An object of the present invention, therefore, is to provide an antenna device in which the degradation of an antenna performance is prevented by suppressing the common mode current through a coaxial cable.

The present invention is based on the recognition that when a short-circuit stub structure is provided to the outer conductor of a coaxial cable at the position within 0.25λ (λ is a free space wave length) from the feeding point of a ground antenna element, the impedance of a common mode path becomes infinite to cut off a common mode current through the path, which is shown schematically in FIG. 2. A short-circuit stub structure 14 designated in a dotted line for simplicity is provided at the position within 0.25λ from a feeding point (the point A in the figure). Viewing the point A in a direction designated by an arrow B from the short-circuit stub structure 14, the impedance of the common mode path becomes infinite to cut off the common mode current through the coaxial cable.

It is also preferable that the short-circuit stub structure is provided at the position in a range of 0.15λ–0.25λ from the feeding point of the ground antenna element. FIG. 3 shows a result of the simulation for a standing wave ratio (VSWR) characteristic in a modeled coaxial cable. Three types of models, i.e., an ideal feeding state (an ideal state of no unbalance), a state in which the position of the short-circuit stub structure is at 0.15λ, and a state in which the position of the short-circuit stub structure is at 0.25λ were simulated.

It is appreciated that respective models in which the positions of the short-circuit stub structure were 0.15λ and 0.25λ obtained VSWR characteristic which is substantially the same as that in the ideal state at a desired frequency near to 2.5 GHz to effectively suppress the generation of a common mode current. When an electric wave of 2.5 GHz band is received, for example, the length from the ground antenna element to the short-circuit stub structure may be 1.8 cm–3 cm.

Therefore, the antenna device in accordance with the present invention comprises a radiation antenna element and ground antenna element formed on one surface of a dielectric substrate; a conductive housing provided near to and surrounding the radiation antenna element and ground antenna element; a coaxial cable, the center conductor of one end of the coaxial cable being connected to the feeding point of the radiation antenna element, and the outer conductor of the one end of the coaxial cable being connected to the feeding point of the ground antenna element; and a short-circuit stub structure provided to the outer conductor of the coaxial cable, the short-circuit stub structure being electrically connected to the conductive housing.

It is preferred that the short-circuit stub structure is provided at the position within 0.25λ, preferably in the range of 0.15λ–025λ, more preferably in the range of 0.15λ–0.23λ from the feeding point of the ground antenna element.

It is also preferred that the length of the coaxial cable is shorter than κλ, wherein κ is a wave length shortening factor of the coaxial cable, which is a ratio between the wave length in the coaxial cable and the wave length in a free space.

When an electric wave of 2.5 GHz band is received, λ is 128.6 mm, and κλ is 9 cm assuming that κ is 0.7.

The short-circuit stub structure includes a metal terminal being connected to the outer conductor of the coaxial cable and to the base plate or the housing.

BEST MODE FOR CARRYING OUT THE INVENTION

An embodiment of the antenna device according to the present invention will now be described with reference to the drawings.

Figure 1:
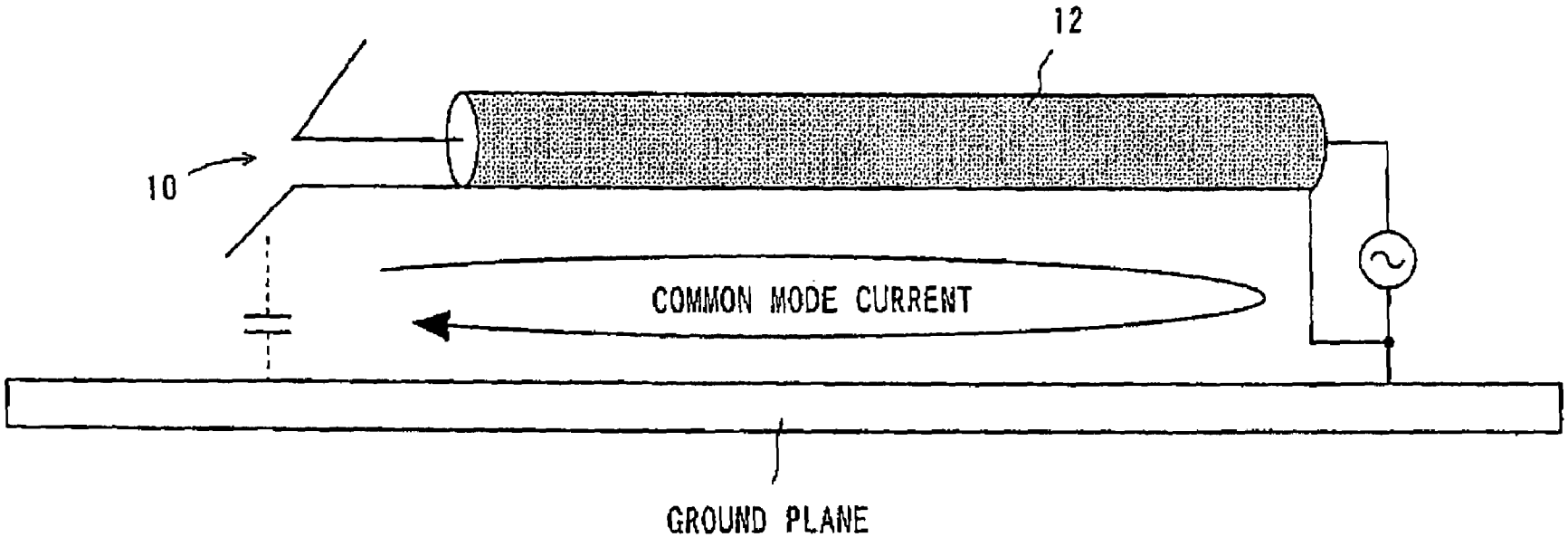
FIG. 1 shows the condition where a common mode current flows through a coaxial cable connected to a coplanar antenna.
Figure 2:
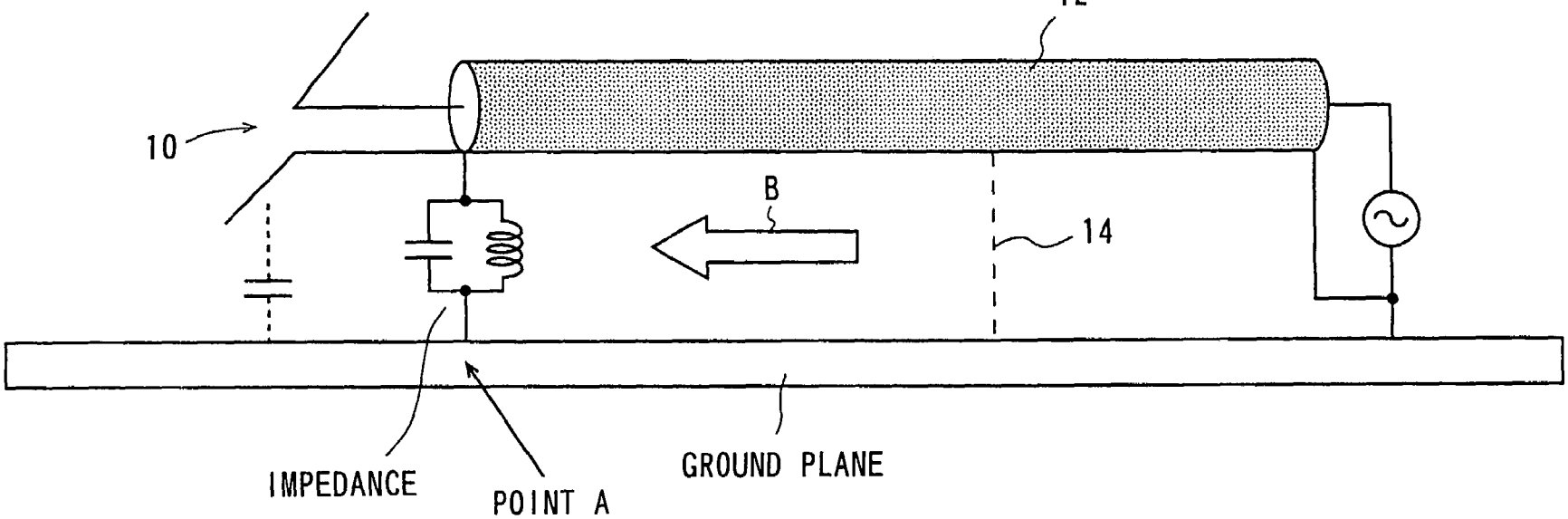
FIG. 2 shows a schematic view for illustrating the cut off of a common mode current when a short-circuit stub structure is provided.
Figure 3:
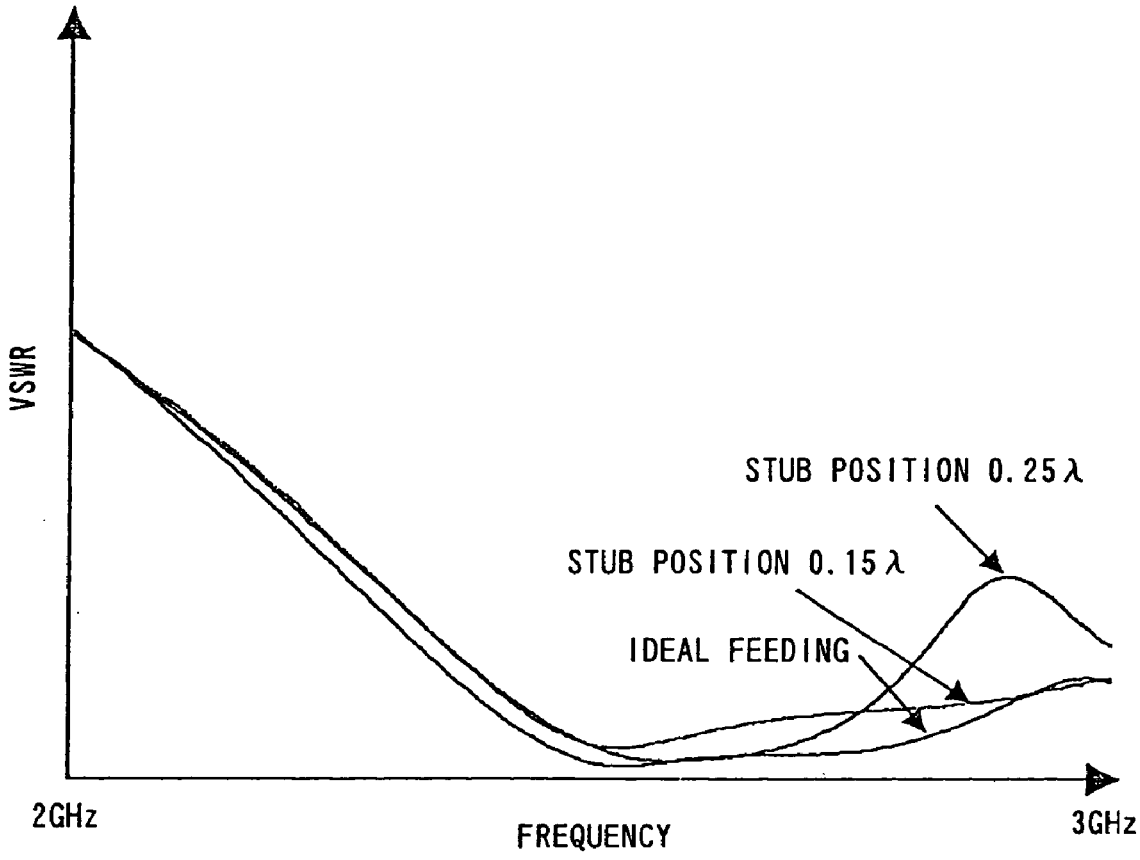
FIG. 3 shows a result of the simulation for VSWR characteristic in a modeled coaxial cable.
Figure 4:
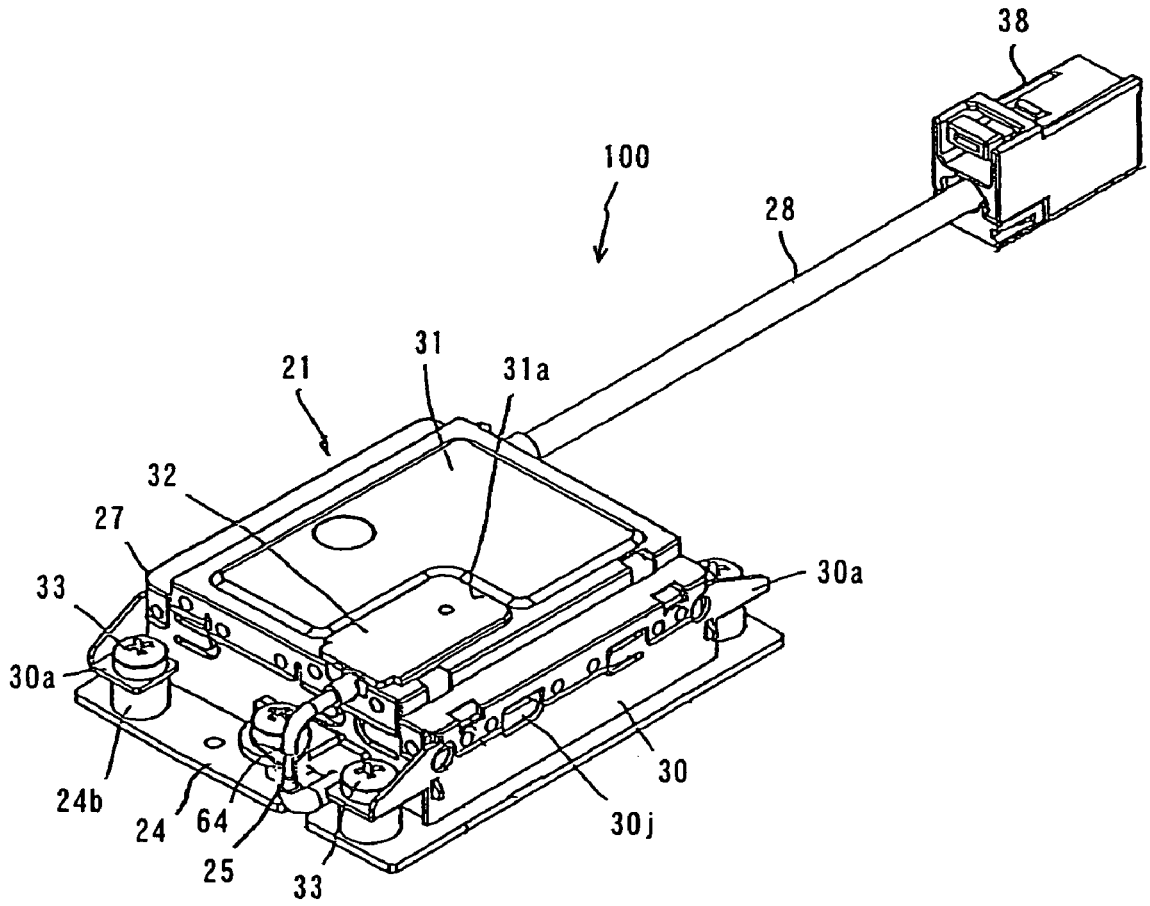
FIG. 4 shows a perspective view of an antenna device according to the present invention.
Figure 5:
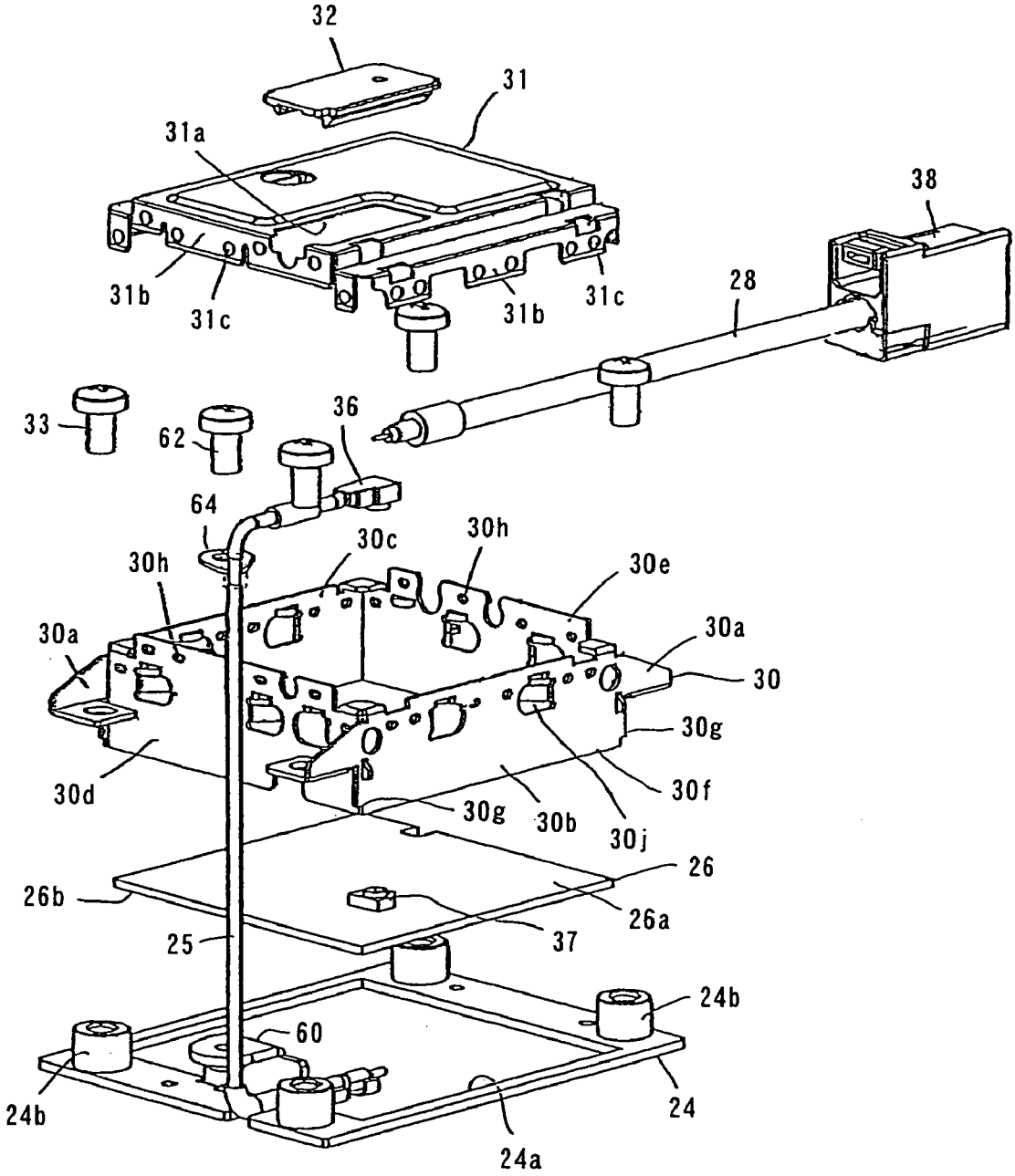
FIG. 5 shows an exploded view of the antenna device in FIG. 4.

FIG. 4 shows a perspective view of the antenna device 100 according to the present invention, and FIG. 5 shows an exploded view thereof. In FIG. 5, the condition is shown in which an electronic circuit unit 21 is fixed to a base plate 24.

The antenna device 100 mainly comprises a coplanar antenna formed on the inner surface of a window glass panel of a motor vehicle, the base plate 24 made of a stainless steel fixed to the inner surface of the window glass panel so as to surround the coplanar antenna, and an electronic circuit unit 21 detachably fixed to the base plate.

Figure 6:
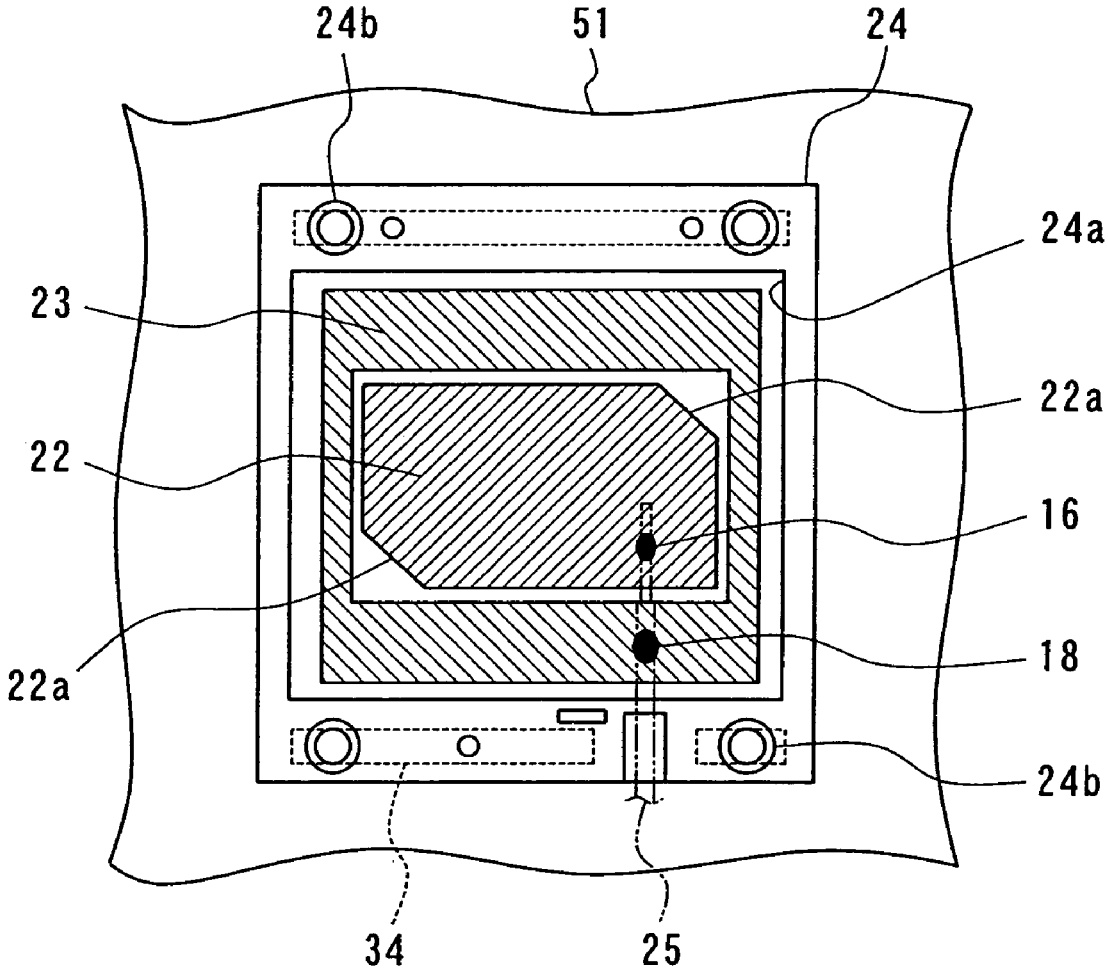
FIG. 6 shows the condition in which the base plate is fixed to a window glass panel so as to surround the coplanar antenna formed on the window glass panel.

FIG. 6 shows the condition in which the base plate 24 is fixed to a window glass panel 51 so as to surround the coplanar antenna formed on the panel 51. The coplanar antenna comprises a radiation antenna element 22 and a ground antenna element 23. The radiation antenna element 22 is a batch electrode formed in a substantial square shape, and comprises degenerate isolation elements 22*a* formed as notched portion on both corners in a direction of one diagonal line. The ground antenna element 23 is a ground electrode formed in a frame shape which surrounds the radiation antenna element 22 with holding a predetermined space thereto. The radiation antenna element 22 and ground antenna element 23 are both conductive layers made of good conductive metal such as Ag. To the feeding point of the radiation antenna element 22 connected is the central conductor of a coaxial cable 25 by soldering. The connecting points (feeding points) by soldering are shown by reference numerals 16 and 18, respectively.

While the coplanar antenna may be formed at any position of the window glass panel 51, the coplanar antenna may also be formed on a shielding film, for example a black shielding film on the window glass panel for the case that the beauty of the window glass panel is required.

The electronic circuit unit 21 comprises a circuit board 26, a box-shaped housing 27 for containing the circuit board 26, the housing being made of a steel plate the surface thereof is Sn plated, and a coaxial cable (an input/output cable) 28 one end thereof is connected to the circuit board and the other end thereof is connected an outer receiver (not shown).

The housing 27 comprises a square frame 30 made of a steel plate for surrounding and holding the circuit board 26, a cover 31 made of a steel plate for covering the frame 30 so as to envelope the circuit board 26, and a connector cover 32 for covering a notched portion 31*a* of the cover 31.

The base plate 24 has a square frame shape surrounding an opening 24*a*, on the base plate provided being a plurality of female screws 24*b*. The frame 30 is fixed to the base plate 24 by connecting a male screw 33 through an outwardly protruded portion 30*a* of the frame 30 of the housing 27 to each of the plurality of female screws. That is, the electronic circuit unit 21 of the antenna device 100 is fixed detachably to the base plate 24. As shown in FIG. 6, the base plate 24 is fixed to the window glass panel 51 by using a moisture-curing resin 34.

As shown in FIG. 5, the square frame 30 mainly comprises a pair of opposing side walls 30*b* and 30*c* and a pair of opposing side walls 30*d* and 30*e*. The longitudinal both ends of each of the side walls 30*b* and 30*c* are provided with the outwardly protruded portion 30*a*, respectively. The end of the frame 30 opposing to the window glass panel 51 is a fitting portion 30*f* to be inserted into the opening 24*a* of the base plate 24. The stoppers 30*g* formed respectively near to four corners of the fitting portion 30*f* are hit to the base plate 24. In this manner, the depth of the fitting portion 3*f* to be inserted into the opening 24*a* is set to be lower than the thickness of the base plate 24. The stoppers 30*g* are formed at the longitudinal both ends of the side walls 30*b* and 30*c*, respectively, and are slightly protruded with respect to the neighbored side walls 30*d* and 30*e*. A plurality of small holes 30*h* are opened in the edge portion of the frame 30 opposite to the fitting portion 30*f*.

One surface of the circuit board 26 is a component mounting surface 26*a* on which various electric components (not shown) including an amplifier are mounted. To the component mounting surface 26*a* connected is one end of the coaxial cable 25 through a pair of connectors 36 and 37, the other end of the coaxial cable being connected to the radiation antenna element 22 and ground antenna element 23. That is, the one end of the coaxial cable 25 is connected to the input of the amplifier. In FIG. 5, there are shown the connector 36 for the coaxial cable 25 and the connector 37 for the circuit board 26 which constitutes the connector pair with the connector 36.

To the component mounting surface 26*a* soldered is one end of a coaxial cable 28 the other end thereof is provided with a connector 38. A plurality of peripheral portions of the component mounting surface 26*a* are soldered to the frame 30, thereby the frame 30 functions electrically as a ground and the circuit board 26 and the frame 30 are mechanically coupled. The other surface (back surface) of the circuit board 26, i.e., the surface opposing the radiation antenna element 22 and ground antenna element 23 is an electric wave reflecting surface 26*b* on which a conductive layer consisting of a good conductive metal such as Au is formed. The peripheral portion of the electric wave reflecting surface 26*b* is supported by means of tongues 30*j* at a plurality of positions.

The cover 31 is provided with the notched portion 31*a* which is covered by the connector cover 32. The connector 37 for the circuit board 26 is exposed in the notched portion 31*a*, so that the connector 36 of the coaxial cable 25 may be connected to the connector 37 with the frame 30 including the circuit board 26 being covered by the cover 31. A plurality of bent strips 31*b* are provided along the substantially entire perimeter of the cover 31, which are fitted to the side walls 30*a*–30*e* of the frame 30. The bent strip 31*b* is provided with a number of small fitting protrusions 31*c* protruding inwardly which are arranged at the positions corresponding to small holes 30*h* of the frame 30. Each protrusion 31*c* may be inserted into the corresponding small hole 30*h* by the elasticity of the bent strip 31*b*. Therefore, the cover 31 may easily cover the frame 30 in a snap fitting manner. Before the cover 31 is provided, the circuit board 26 may easily be mounted to the frame 30.

According to the antenna device 100 described above, the back surface of the circuit board 26 is the electric wave reflecting surface 26*b* opposing the radiation antenna element 22 and ground antenna element 23, so that the radiation gain in an incoming direction of the electric wave may be increased.

Next, the formation of a short-circuit stub structure to the coaxial cable 25, which is a feature of the present invention, will be described.

The coaxial cable 25 connected to the feeding points of the radiation antenna element 22 and ground antenna element 23 on the window glass panel is uprighted at the end of the base plate 24 and bent toward the notched portion 31*a* of the cover 31 so that the connector 36 reaches to the notched portion 31*a*. A short-circuit stub structure is provided in such a manner that a part of the outer sheath of the coaxial cable 25 is removed to expose the outer conductor thereof and a ring-shaped metal terminal 64 is crimped to the exposed outer conductor.

The ring-shaped metal terminal 64 is fixed to an acceptance member 60 made of a stainless steel fixed on the base plate 24 by means of a screw 62. The terminal 64 is provided at the position within 0.25λ from the feeding point 18 of the ground antenna element 23.

In this embodiment, while the ring-shaped metal terminal 64 is fixed to the acceptance member 60 by means of a screw, the fixing means is not limited thereto, i.e., any means having the electrical and mechanical coupling structure may be utilized. For example, a bolt, a cotter and the like may be used.

According to the short-circuit stub structure described above, the outer conductor of the coaxial cable 25 is electrically connected to the base plate 24 through the ring-shaped metal terminal 64, the screw 62, and the acceptance member 60. The base plate 24 is electrically connected to the housing 27 described above, so that the housing 27 and base plate 24 constitute the ground plane with respect to the coaxial cable 25.

While there is a capacitance between the ground plane and the ground antenna element 23, a common mode current does not flow through the coaxial cable, because the short-circuit stub structure is provided at the position within 0.25λ from the feeding point 18 of the ground antenna element 23.

Figure 7:
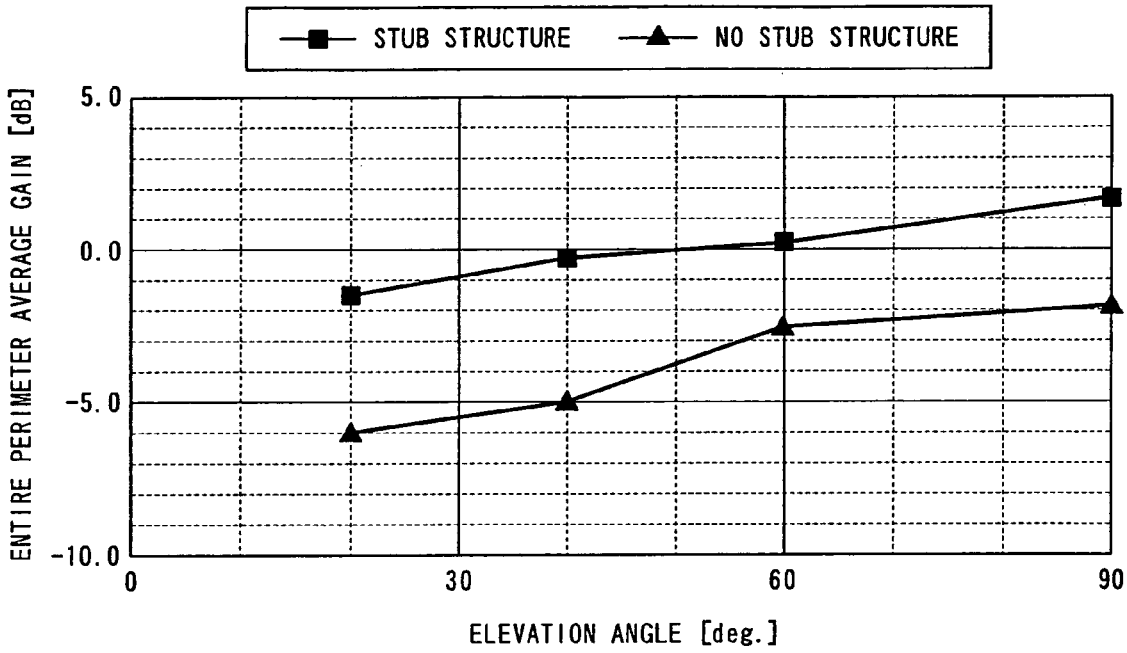
FIG. 7 shows one example of the improvement of the antenna device performance due to the short-circuit stub structure.

An example of the performance improvement of an antenna device provided on a rear window glass panel of a motor vehicle by means of a short-circuit stub structure will now be described. Reception performances measured for the case where a short-circuit stub structure was provided and the case where a short-circuit stub structure was not provided are shown in FIG. 7. An elevation angle characteristic was measured as a reception performance. In FIG. 7, abscissa designates an elevation angle, and ordinate an average reception level (i.e., an entire perimeter average gain) at an elevation angle. It is appreciated that the gain for the case where the short-circuit stub structure was provided is larger than that for the case where the short-circuit stub structure was not provided.

Figure 8B:
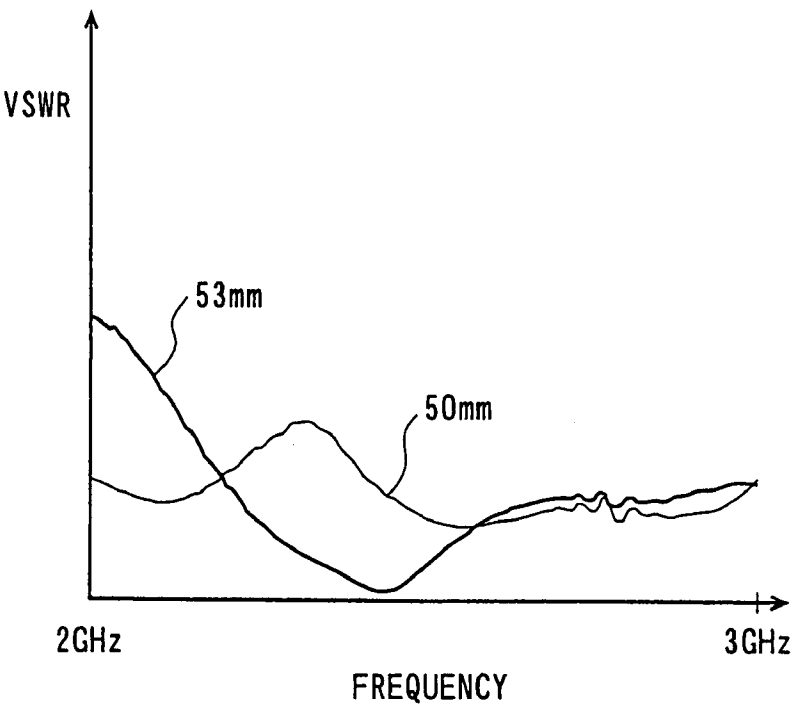
FIGS. 8A and 8B show the measured results of VSWR characteristic.
Figure 8A:
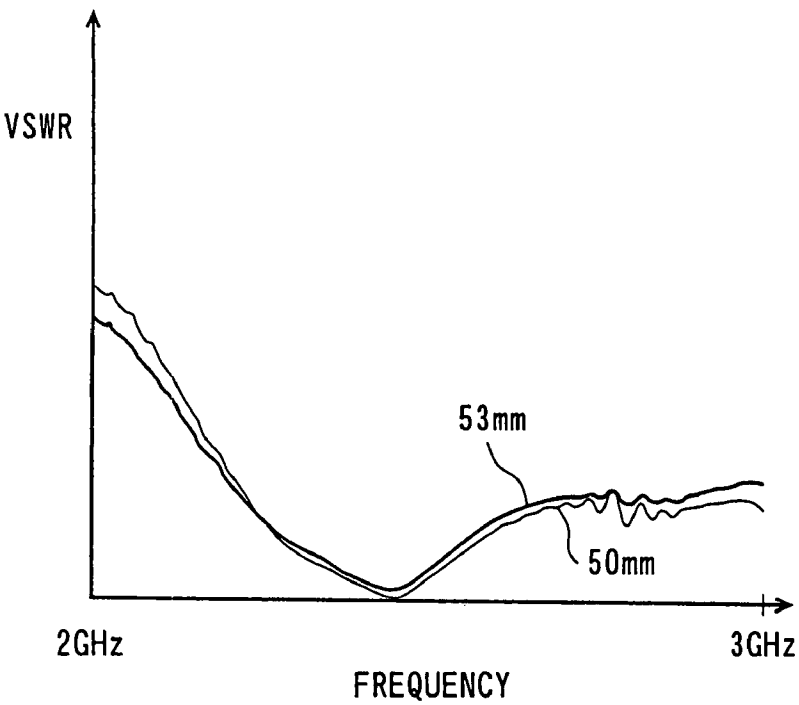

It was recognized by experiments that an impedance characteristic (i.e., VSWR characteristic) was not varied for the case a short-circuit stub structure was provided, even if the length of the coaxial cable 25 was varied. It was assumed that the wave length shortening factor κ of the coaxial cable was 0.7, and a wave length λ was 128.6 mm. VSWR characteristics were measured for the case where a short-circuit stub structure was provided and the case where a short-circuit stub structure was not provided in the antenna device using the coaxial cable having a design length of 53 mm (0.59 κλ) or 50 mm (0.56 κλ). Measured results are shown in FIGS. 8A and 8B. It is appreciated that VSWR characteristic was not varied for the case a short-circuit stub structure was provided, even if the length of the coaxial cable 25 was varied.

The short-circuit stub structure in the embodiment described above utilizes the ring-shaped metal terminal 64. This metal terminal has also following function. That is, the coaxial cable 25 is mechanically held by means of the metal terminal 64, so that the portion of the coaxial cable near to the connector 36 is prevented from being bent when the electric circuit unit 21 is detached to be exchanged. The metal terminal 64 has also effects such that the stress added to the feeding point is decreased to reduce the load to the soldered portion when the connector 36 of the coaxial cable is decoupled from the electric circuit unit 21.

While the ring-shaped metal terminal 64 is connected to the base plate 24 by the screws 33, the metal terminal may be connected to the base plate by soldering. In this case, the metal terminal 64 is not be needed to be ring-shaped. The short-circuit stub structure such as a plug and jack may also be used. In this case, the plug is connected to the outer conductor of the coaxial cable 25, and the jack to the base plate 24. Alternatively, the amplifier input connector 36 may be used as a short-circuit stub structure by setting the length of the coaxial cable 25 to approximately 0.25λ. This is based on the face that the ground contact of the connector 36 is generally connected to the housing.

While the electric circuit unit 21 is detachably attached to the base plate 24 in the embodiment described above, the electric circuit unit 21 may be fixed to the base plate 24.

The invention claimed is:

1. An antenna device, comprising:

a radiation antenna element and ground antenna element formed on one surface of a dielectric substrate;

a conductive housing provided near to and surrounding the radiation antenna element and ground antenna element, the ground antenna element being spaced from the conductive housing;

a coaxial cable, the center conductor of one end of the coaxial cable being connected to the feeding point of the radiation antenna element, and the outer conductor of the one end of the coaxial cable being connected to the feeding point of the ground antenna element; and a short-circuit stub structure provided to the outer conductor of the coaxial cable, the short-circuit stub structure being electrically connected to the conductive housing.

2. The antenna device according to claim 1, further comprising a frame-shaped conductive base plate provided on the dielectric substrate, the conductive base plate having an opening surrounding the radiation antenna element and ground antenna element, wherein the conductive housing is attached to the base plate.

3. The antenna device according to claim 2, wherein a connector is connected to the other end of the coaxial cable.

4. The antenna device according to claim 3, wherein the length of the coaxial cable is shorter than $\kappa\lambda$, $\lambda$ being a free space wave length of an electric wave received by the radiation antenna element and ground antenna element, and $\kappa$ being a wave length shortening factor of the coaxial cable.

5. The antenna device according to claim 4, wherein the short-circuit stub structure is provided at the position within $0.25\lambda$ from the feeding point of the ground antenna element.

6. The antenna device according to claim 5, wherein the short-circuit stub structure includes a metal terminal being connected to the outer conductor of the coaxial cable and to the base plate or the housing.

7. The antenna device according to any one of claims 1–6, wherein the dielectric substrate is a window glass panel of a motor vehicle.

* * * * *